United States Patent [19]

Fikse

[11] 4,283,090

[45] Aug. 11, 1981

[54] CONVEYOR MOUNTED EXCAVATOR

[75] Inventor: Tyman H. Fikse, Seattle, Wash.

[73] Assignee: The Robbins Company, Seattle, Wash.

[21] Appl. No.: 80,408

[22] Filed: Oct. 1, 1979

[51] Int. Cl.[3] ..... E21D 9/10; E21D 9/12

[52] U.S. Cl. ..... 299/33; 299/65

[58] Field of Search ..... 299/31, 33, 64, 65

[56] References Cited

U.S. PATENT DOCUMENTS

| | | | |
|---|---|---|---|
| 1,082,319 | 12/1913 | Gibson | 299/65 X |
| 1,549,699 | 8/1925 | Wilson | 299/64 |
| 3,506,310 | 4/1970 | Gruere | 299/33 X |
| 3,556,599 | 1/1971 | Fikse | 299/33 |
| 3,612,609 | 10/1971 | Reuls | 299/33 |
| 3,922,016 | 11/1975 | Tyslauk et al. | 299/31 |
| 4,043,137 | 8/1977 | Jutte et al. | 299/31 X |

*Primary Examiner*—Ernest R. Purser

*Attorney, Agent, or Firm*—Graybeal & Uhlir

[57] ABSTRACT

The front end portion of an endless belt type conveyor is detachably connected to the floor of a self-propelled tunneling shield, and the rear end of the conveyor is supported inclined upwardly by a trailing, mobile power unit which rides on spaced apart rails disposed along the tunnel floor. A pair of double acting hydraulic cylinders advance and retract a boom supporting carriage along support rails mounted along the length of the conveyor. An elongate boom is mounted on the carriage for movement with the carriage toward and away from the tunnel face. A combination digging and hoeing excavator tool is carried by the front end portion of the boom to loosen material at the tunnel face and then hoe the loosened material rearwardly onto the conveyor.

10 Claims, 9 Drawing Figures

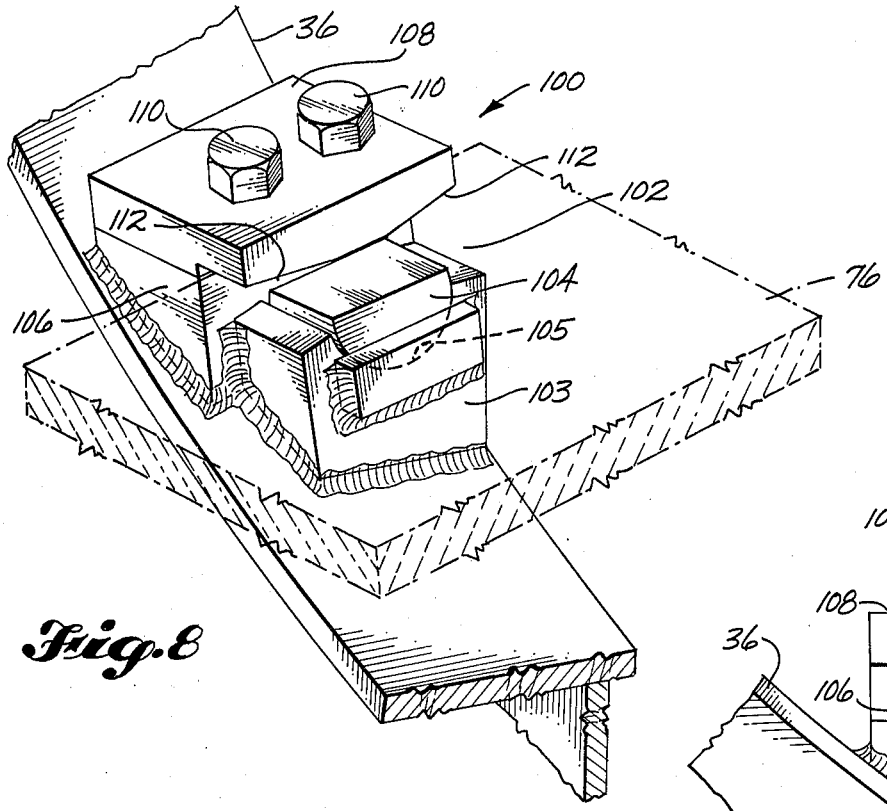
Fig. 8
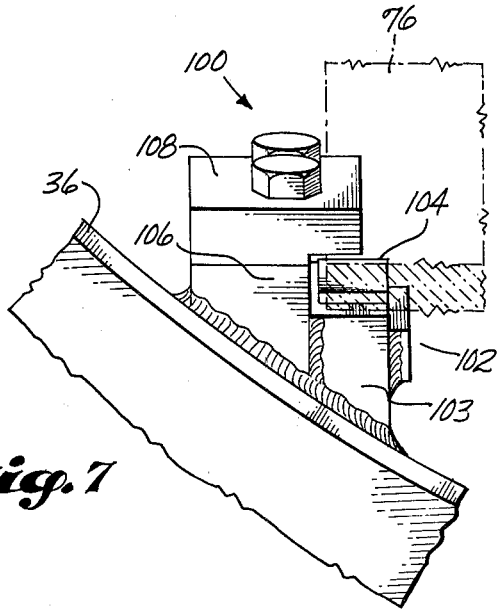
Fig. 7
Fig. 6
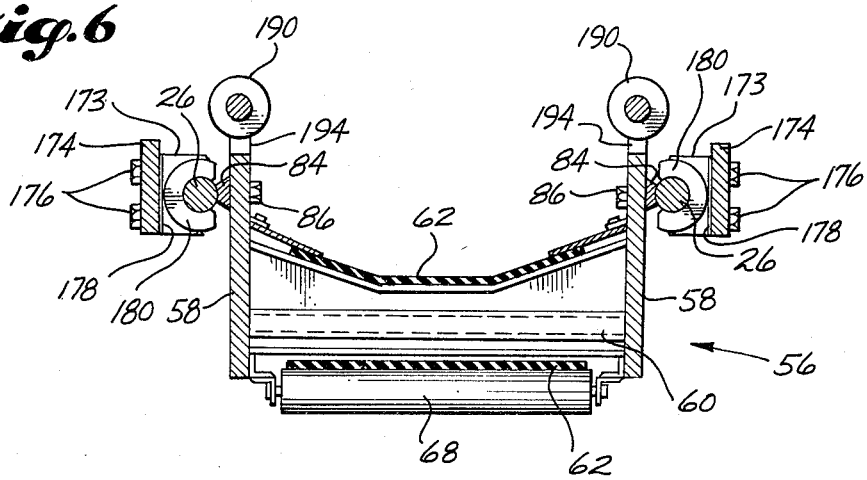

CONVEYOR MOUNTED EXCAVATOR

BACKGROUND OF THE INVENTION

1. Field of the Invention

The present invention relates to tunneling machines, and particularly to a new shielded tunneling machine incorporating an excavator and conveyor constructed as a unit.

2. Description of the Prior Art

Since the days in which tunnels were dug by hand with a pick and shovel, numerous types of machines have been developed in an attempt to more efficiently excavate tunnels. Powered jack hammers and shovels, such as disclosed in McDowell U.S. Pat. No. 1,100,142, have been utilized to more quickly loosen the earth at the tunnel face. Also, conveyors have been employed to more rapidly load the loosened materials at the tunnel face onto cars for removal rearwardly through the tunnel.

More recently, sophisticated tunneling and mining machinery has been developed. Forwardly extending booms having powered excavating tools at their front ends for excavating material at the tunnel face and an endless belt type conveyor for loading such loosened materials onto mine cars have been mounted on a single mobile vehicle. Generally, such a vehicle is self-propelled and rides either on tracks or ground engaging wheels. Examples of tunneling machines of this type are disclosed by Graham U.S. Pat. No. Re. 24,479; Gelfgren et al U.S. Pat. No. 3,726,382; Nakashima U.S. Pat. No. 3,958,831; Jenkins et al U.S. Pat. No. 3,978,675; and Beckmann at page 120.

On larger, less mobile vehicles rather than moving the entire chassis when digging at a tunnel face, the excavating portion of the machine has been adapted to move in the fore-and-aft direction relative to both the vehicle and the conveyor. Hoar U.S. Pat. No. 1,162,607, Shimada et al. U.S. Pat. No. 3,574,405 and Silvestro et al. U.S. Pat. No. 3,675,433 all disclose such types of tunneling machines. In all of these patents, an excavator is mounted on a carriage which is in turn supported by a vehicle frame for longitudinal movement within a tunnel.

If the ground material through which the tunnel is being formed is loose or contains a large amount of moisture, a shielded tunneling machine, rather than the unshielded types described above, may be required. In general, a shielded tunneling machine is capable of digging a tunnel which is more uniform in cross section and thus easier to line than a tunnel dug with an unshielded machine. Powered tunneling shields are usually constructed in two longitudinally aligned halves interconnected by powerful hydraulic rams arranged in a ring about the inside diameter of the two halves. These shields are propelled by initially extending the rams to push the front half of the shield forwardly into the tunnel face. After the rams have reached their full extension, they are retracted to pull the rear half of the shield forwardly into abutment with the shield front half to complete the stepwise movement. Examples of powered tunneling shields are disclosed by McDowell U.S. Pat. No. 1,100,142; Parker U.S. Pat. No. 2,111,405; Tabor U.S. Pat. Nos. 3,382,002, 3,404,535 and 3,404,920; Hayes U.S. Pat. No. 3,427,813; Fikse U.S. Pat. No. 3,556,599; Cunningham U.S. Pat. No. 3,578,809; Reuls U.S. Pat. No. 3,612,609; Jutte et al. U.S. Pat. No. 4,043,137; and Fritz U.S. Pat. No. 4,055,959.

Conveyors have been added to powered tunneling shields to transport the loosened ground material rearwardly through the tunnel. Examples of this type of tunneling machine are disclosed by the above mentioned Tabor '535, and Hayes '813 patents. If the spoil at the tunnel face is firmly packed, the tunneling shield by itself may not be capable of removing it and thus the spoil may have to be cut away with an additional apparatus such as a powered shovel, pick or rotary cutter. Examples of types of tunneling machines incorporating a powered shovel are disclosed by the afore noted McDowell '142 and Tabor '920 patents. The above discussed '599 and '809 patents to Fikse and Cunningham, respectively, disclose types of shielded tunnel machines utilizing powered picks. In addition, the previously noted Jutte et al '137 patent involve a type of shielded tunneling machine constructed with two powered rotary cutters.

Rather than utilizing a separate conveyor and powered excavating device, shielded tunneling machines have also employed a mobile vehicle on which both a conveyor and powered excavating apparatus have been mounted. Generally the digging or cutting tool is mounted on the front end portion of a forwardly extending boom which is pivotally supported by the vehicle. Examples of such tunneling machines are disclosed by the Parker '405 and Reuls '609 patents.

Shielded tunneling machines have also been constructed with powered excavators which are mounted on the shield itself for movement therewith. In this type of structure, the reaction forces created by the excavating tool as it loosens material at a tunneling face is carried by the entire shield rather than just by a mobile vehicle. Thus, relatively large excavating tools can be utilized to more quickly cut away the tunnel face. In general, this type of tunneling machine includes a carriage which is suspended downwardly from overhead tracks or rails for fore-and-aft movement relative to the shield. A boom having a bucket or other type of excavating tool mounted to its front end is pivotally connected to the carriage for travel therewith. Examples of such tunneling machines are disclosed by the Tabor '920 patent wherein a bucket type excavator empties muck into mine cars; the Fikse '599 patent wherein an excavating tool includes a blade portion for hoeing the spoil onto a conveyor; and the Jutte et all '137 patent wherein a cutter support boom is constructed with an integral conveyor for transporting mined materials back to a second or rear conveyor.

The Cunningham '809 patent discloses a similar tunneling machine wherein an excavator tool support boom is suspended from the ceiling of a powered tunneling shield by a four-bar link mechanism. To permit the excavating tool to move transversely about the tunneling face, the four-bar link mechanism is adapted to pivot about a vertical axis.

A major drawback of shielded tunneling machines, especially those incorporating an excavating device mounted directly to the shield, is that considerable time and expense is incurred during the preliminary stages of a tunneling project even before the machine can be used to dig a tunnel in its designed manner. Tunnels are usually begun by first digging a vertical hole down to the level corresponding to the elevation of the desired tunnel. Next the shield portion of the tunneling machine is lowered into the vertical hole and aligned with the direction of the desired tunnel. Using the rear wall of the vertical hole as a backstop, the shield is extended forwardly in its normal manner while the tunnel face is cut away either manually or through the use of a powered portable cutting device. Once the shield is buried, the remainder of the tunneling machine must then be assembled within the shield. The dark, dusty, and cramped quarters within the shield are not ideal conditions under which to assemble complicated, heavy machinery piece by piece. As a result, this procedure takes a great deal of time and often the tunneling machine is improperly assembled. Consequently, the machine often must be later required or reassembled, which is an expensive and time-consuming operation.

SUMMARY OF THE INVENTION

The present invention relates to an improved tunneling machine which, in basic form, is a self-propelled tunneling shield providing overhead protective cover at the face region of the tunnel. The front end portion of an endless belt type conveyor is detachably connected to the tunneling shield. The conveyor is constructed generally in the form of an elongate beam having side portions to which are secured a pair of elongate support rails disposed in spaced parallel relationship along the length of the conveyor beam. A carriage for supporting an elongate boom is mounted on the support rails for fore-and-aft travel along the conveyor. The rear end portion of the boom is pivotally connected to an upstanding front end portion of the carriage, and the front end portion of the boom is adapted to rotate about its longitudinal axis. A combination digging and hoeing excavator tool is mounted on the front end of the boom. A fluid jack is disposed on each side of the boom for pivoting the boom up and down and sideways to move the excavator tool about the tunnel face. The forward end of each jack is connected to an intermediate portion of the boom while the rear end of each jack is pivotally connected to a forward portion of the carriage at an elevation below the connection of the rear end of the boom to the carriage. Furthermore, the rear end portion of a double acting fluid jack is anchored to each side of the conveyor for advancing and retracting the carriage along the support rails. From its corresponding rear end, each of these fluid jacks extends closely along an upper side portion of the conveyor frame and connects with the forward end portion of the carriage.

The present invention further includes a socket mounted on the tunneling shield at each side of the conveyor for vertically constraining the front end portion of the conveyor while permitting the conveyor to slide longitudinally and rock up and down about the sockets. Each socket includes a lower pivoting support surface which bears upwardly against the underside of a flange extending laterally from the forward end portion of the conveyor beam structure. Each socket also includes a detachable cap which is nominally spaced slightly above the conveyor beam flanges to prevent the front end portion of the conveyor from rising upwardly during use of the excavator tool.

The rear end portion of the conveyor is pivotally supported for rotation about a horizontal axis by a mobile power unit. The power unit also provides fluid under pressure to power the conveyor, the excavator tool, the jacks which pivot the boom about the tunnel face, and the jacks which move the carriage along the conveyor beam.

It is a principal object of the present invention to provide a shielded tunneling machine which requires a minimum of assembly at the job site, thereby enabling the machine to be expeditiously buried in the ground when beginning a tunnel.

Another object of the present invention is to provide a tunneling machine in which the excavating and conveying mechanisms are constructed together as a single unit which then can be quickly and easily connected to the shield after it has been buried in the ground.

One more object of the present invention is to provide a tunneling machine in which the reaction loads generated by the excavating tool are carried by the shield itself.

A further object of the present invention is to provide a tunneling machine which eliminates the need to excavate a tail tunnel to receive portions of the tunneling machine when beginning a tunnel.

Yet another object of the present invention is to provide a tunneling machine in which a conveyor and digging tool carrying boom are detachably disconnectible as a single unit from the shield and then movable rearwardly away from the tunnel face.

An additional object of the present invention is to provide a tunneling machine which permits lateral movement between the shield and the conveyor so that the tunnel can be formed with relatively sharp curves compared with tunnels dug with conventional shielded tunneling machines.

Still another object of the present invention is to provide a tunneling machine utilizing a self-contained power unit for powering the entire machine except the shield itself.

One further object of the present invention is to provide a tunneling machine wherein the number of components which are possibly subject to failure from their exposure to the mined muck is minimized.

BRIEF DESCRIPTION OF THE DRAWINGS

FIG. 6 is an enlarged fragmentary, cross-sectional view of the typical embodiment of the present invention shown in FIG. 1, taken substantially along lines 6—6 thereof;

FIG. 7 is an enlarged, fragmentary, front elevational view of one of the sockets which support the front end portion of the conveyor frame; and FIG. 8 is a greatly enlarged, fragmentary front prospective view of the socket illustrated in FIG. 7.

DETAILED DESCRIPTION

Figure 1A:
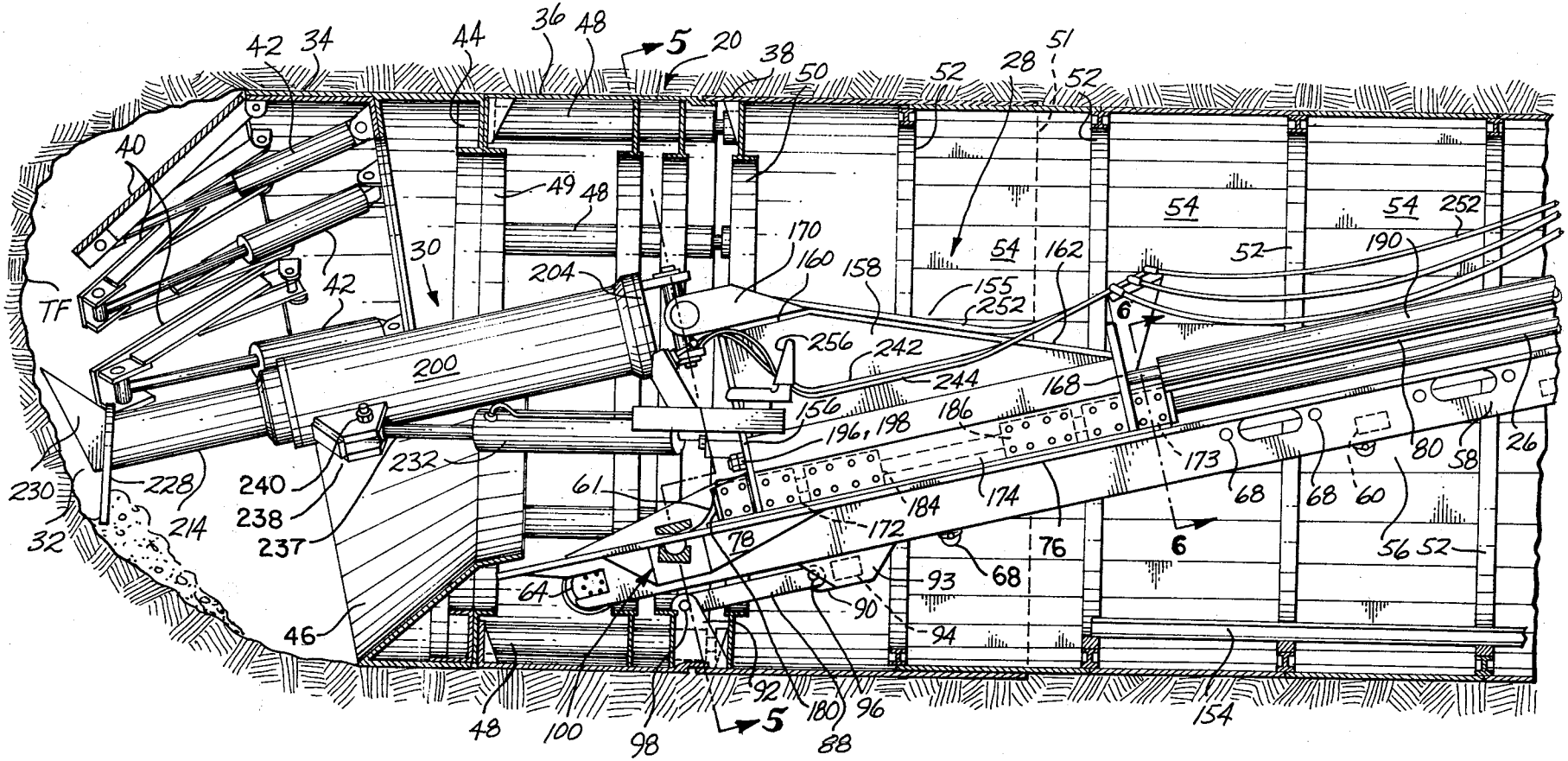
FIGS. 1A and 1B together form a side elevational view of one typical embodiment of the present invention.
Figure 1B:
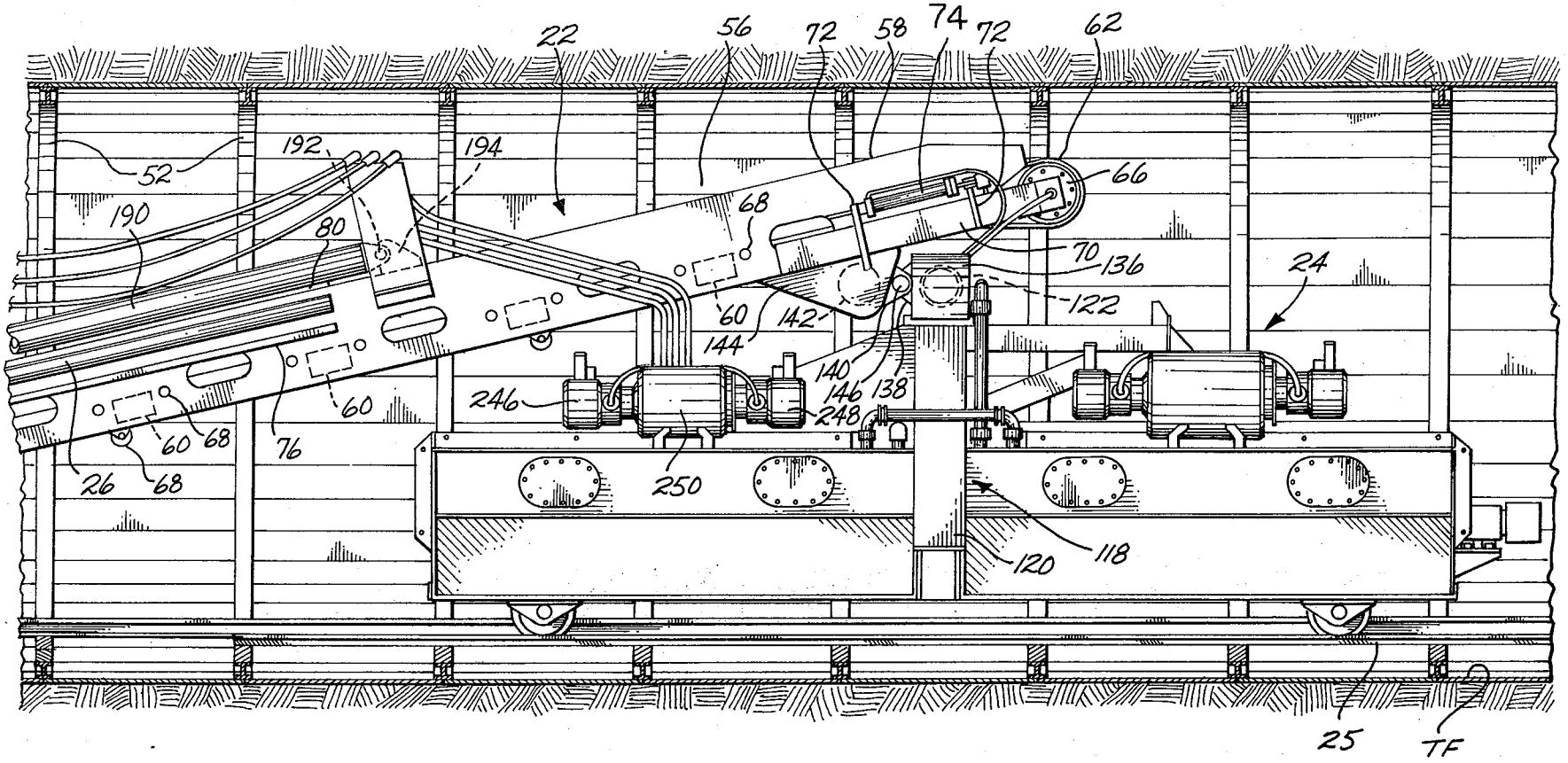

Referring initially to FIGS. 1A and 1B, a tunneling machine utilizing a conveyor mounted excavator constructed according to the present invention basically comprises a shield 20 to which the front end portion of an endless belt type conveyor 22 is detachably connected. The rear end portion of conveyor 22 is supported by a trailing, mobile power unit 24 which rides on spaced rails 25 disposed along the floor of the tunnel. Conveyor 22 includes support rails 26 for supporting and guiding boom support carriage 28 for sliding movement therealong. An elongated boom 30 is in turn mounted on carriage 28 for movement with said carriage toward and away from the tunnel face TF. A combination digging and hoeing excavator tool 32 is carried by the front end portion of boom 30.

Again, referring specifically to FIGS. 1A and 1B, tunneling shield 20, for supporting the overhead earth formation at the region where excavating is taking place, includes a forward section 34, an intermediate section 36 and a tail section 38. The leading or cutting edge of forward section 34 is beveled rearwardly from top to bottom. A plurality of generally pie-shaped breasting doors 40 are pivotally connected along the leading edge of the upper half of forward shield section 34. Each breasting door 40 is opened and closed by a thrust ram 42 which is pivotally connected between its corresponding door 40 and shield forward ring 44. To prevent loose material from collapsing too rapidly, thrust rams 42 can be extended to pivot doors 40 forwardly toward tunnel face TF, thereby closing off the upper portion of shield forward section 34. If, on the other hand, tunnel face TF is self-supporting, rams may be retracted to thereby pivot doors 40 rearwardly to assume a position closely adjacent the inner circumference of shield forward section 34. An apron or ramp 46 extends rearwardly and radially inwardly from the front edge of the lower half of shield forward section 34. Apron 46 extends rearwardly a distance sufficient to overlap the front end portion of conveyor 22.

As is conventional in the tunneling field, shield 20 is moved forwardly by a plurality of thrust rams 48 which are interconnected between intermediate section shield ring 49 and ring beam 50 encased within the forward portion of shield tail section 38. As shield 20 advances, tunnel lining 51 is continuously added to the tunnel within the protective confines of shield tail section 38. In the illustrated form, the tunnel lining 51 is composed of circular girth ribs 52 axially spaced apart by longitudinal lagging members 54. With ring beam 50 abutted against forward rib 52, forward and intermediate shield sections 34 and 36, respectively, are pushed adhead a distance approximately equal to the full throw of thrust rams 48. Thereafter, thrust rams 48 are retracted to pull ring beam 50 and its associated shield tail section 38 forwardly so that additional sections of lagging and additional girth ribs 52 can be installed under the cover of said tail section 38.

Figure 3:
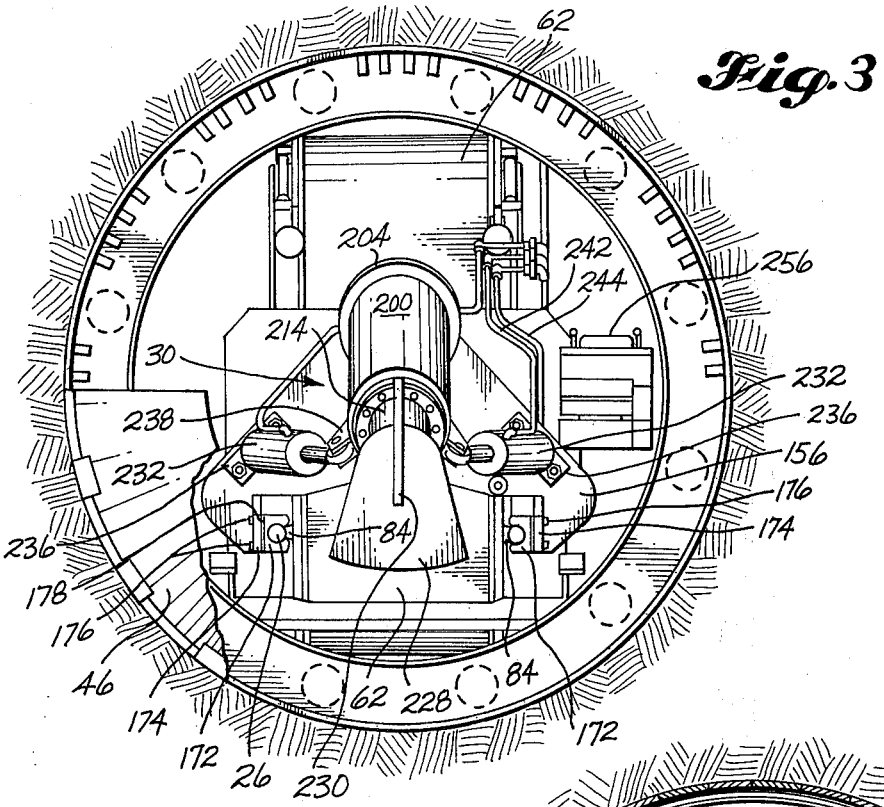
FIG. 3 is a front view of the typical embodiment shown in FIG. 1 with parts removed for clarity.

Conveyor 22, as best illustrated in FIGS. 1A, 1B and 3, extends rearwardly and rises upwardly from the lower portion of shield intermediate section 36 to join at its rearward end with power unit 24. Now, also referring to FIGS. 5 and 6, conveyor 22 is constructed in the form of an elongate beam structure or frame 56 having a pair of upright, elongate, straight side plates 58 which are disposed in spaced parallel relationship by a plurality of tubular cross braces 60 located along the length of frame 56. The upper edge of the forward end portion of each side plate 58 is relieved or notched to form an arcuate front edge 61.

An endless belt 62 is disposed between side plates 58 to ride around a forward pulley 64 and a powered rear pulley 66. The upper and lower runs of endless belt 62 are both supported by a plurality of idler rollers 68 which span across side plates 58. Forward pulley 64 is mounted on the front end portion of side plates 58 while rear pulley 66 is mounted on a frame assembly which is slidable longitudinally relative to forward pulley 64 to thereby tension belt 62. The sliding frame assembly is basically composed of an elongate arm 70 extending forwardly from each end of rear pulley 66 to slidably engage through aligned openings in window plates 72 mounted on the outward surfaces of each side plate 58. A fluid ram in the form of hydraulic cylinder 74 is interconnected between each forward window plate 72 and a corresponding arm 70 to thereby slide said arm relative to window plates 72.

A lower flange 76 extends transversely, laterally outwardly from the outer surface of each conveyor frame side plate 58. Side flanges 76 extend rearwardly from the front end of side plate 58 to a location more than midway along the length of conveyor 22, FIGS. 1A and 1B. A gusset plate 78, shaped generally in the form of a downwardly converging, truncated triangle, overlaps the outer surface of the front end portion of each conveyor frame side plate 58 to abut upwardly against the lower surface of a corresponding side flange 76 to thereby reinforce said two members.

An upper side flange 80 extends laterally outwardly from the upper edge of each conveyor frame side plate 58. Flanges 80 extent rearwardly from the arcuate front edge of side plates 58 to approximately the rearward end of lower side flange 76. A carriage guide and support rail in the form of an elongate, straight circular rod 26 is disposed outwardly of each conveyor frame side plate 58 at an elevation between upper and lower side flanges 76 and 80, respectively, FIGS. 1A, 1B, 5 and 6. Each rod 26 seats against an elongate, straight backing plate 84 having a length approximately the same as rods 26. Each backing plate 84 is constructed with a flat backing surface which abuts against the outside surface of a corresponding conveyor side plate 58. The opposite side of each backing plate 84 is shaped in the form of an arcuate seat having a radius corresponding to the radius of rod 26 for receiving a rod 26 therein. Rod 26 and its corresponding backing plate 84 are held in place by fasteners such as capscrews 86 which extend through aligned cross holes provided in said conveyor frame side plate 58 and backing plate 84 to engage into threaded holes provided in rod 26.

Figure 5:
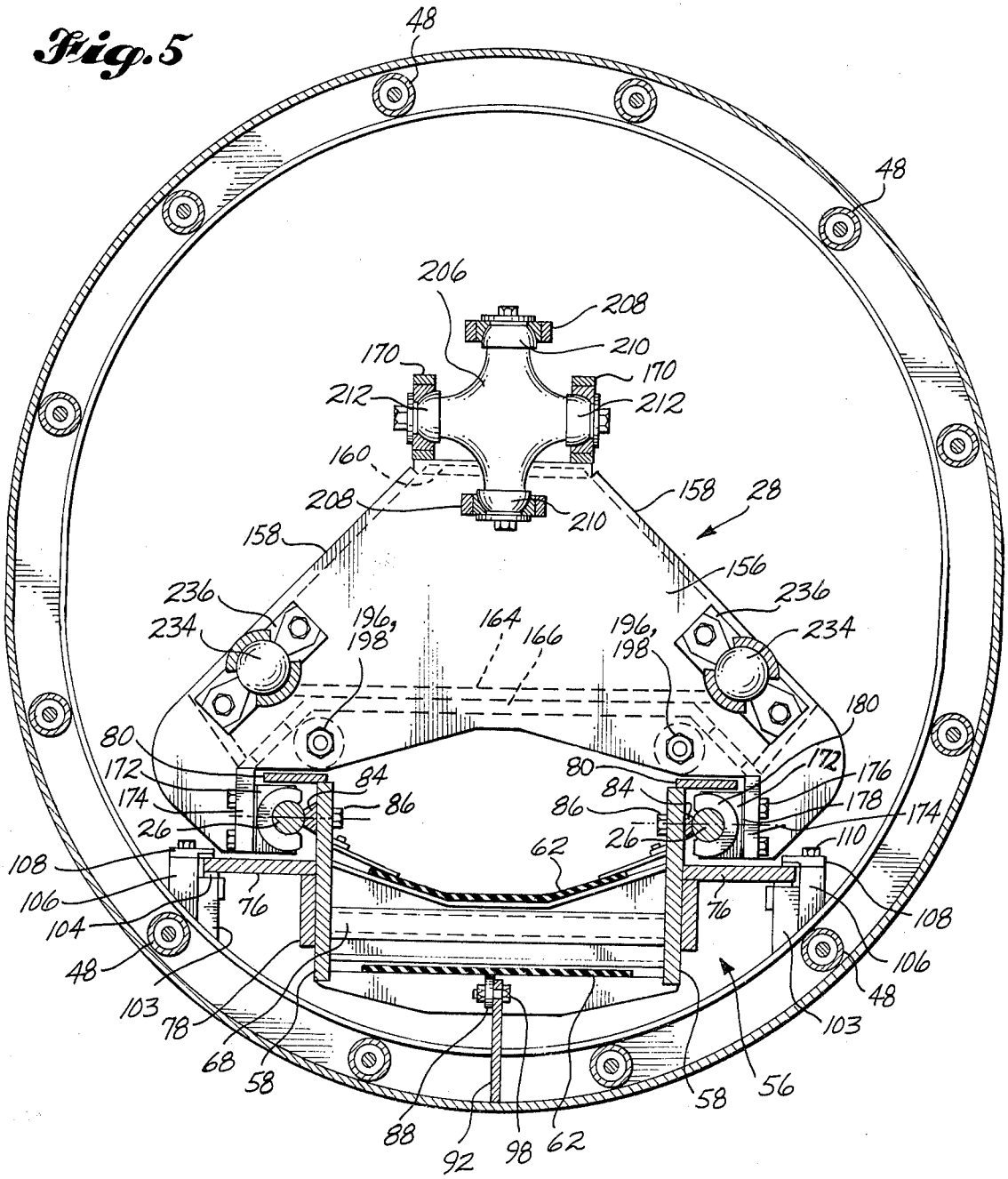
FIG. 5 is an enlarged, fragmentary, cross-sectional view of the embodiment of the present invention shown in FIG. 1, taken substantially along lines 5—5 thereof.

As illustrated in FIGS. 1A, 1B and 5, when in use, the front end portion of conveyor 22 is connected to and located within the protective confines of shield 20. Conveyor 22 is towed behind shield 20 by an elongate link 88 pinned between eye plate 90 affixed to the underside of conveyor 22 and anchor plate 92 fixedly attached to the bottom floor portion of shield intermediate section 36. Eye plate 90 extends longitudinally of conveyor 22 and is disposed centrally between end plates 93 by tubular cross beam 94 fixedly attached to the inside faces of said two end plates 93 to span therebetween. End plates 93 depend downwardly from the lower edge of a corresponding frame side plate 58. A somewhat loosely fitting cross pin 96 extends through aligned openings provided in the rear end portion of link 88 and eye plate 90. A second cross pin 98 extends through somewhat loosely fitting holes provided in anchor plate 92 and in the front end portion of link 88. It can be appreciated that this particular construction allows the front end portion of conveyor 22 to raise and lower relative to shield 20 and also permits conveyor 22 to pivot a limited amount about a vertical axis relative to shield 20, thereby enabling tunneling machines according to the present invention to form tunnels which curve about a relatively small radius.

As best shown in FIGS. 1A, 5, 7 and 8, the front end portion of conveyor 22 is vertically supported and constrained and also laterally constrained relative to shield 20 by sockets 100 disposed at each side of said conveyor 22. Each socket 100 generally includes a base portion 102 which is welded or otherwise affixed to the lower portion of the opposite inside sidewalls of shield intermediate section 36. Each socket base portion 102 includes an upwardly open block member 103 for closely receiving a semi-circular segment member 104 having a flat upper surface which bears against the underside of each conveyor lower side flange 76 at a location longitudinally adjacent gusset plate 78. Segment member 104 is adapted to pivot or rock within a correspondingly shaped cavity or slot 105 formed in block member 103 in response to the inclination of conveyor 22 relative to shield 20. Each socket base portion 102 also includes a vertical side member 106 which is disposed slightly outwardly of an adjacent side edge of conveyor lower side flanges 76 to thereby laterally constrain the forward end portion of conveyor 22.

Each socket 100 is also constructed with a removable cap 108 which is detachably connectible to a corresponding base portion 102 by fasteners such as capscrews 110 extending through clearance holes provided in said cap 108 and engaging within aligned, tapped holes provided in side members 106. As best shown in FIG. 8, each cap 108 has a downwardly directed, longitudinally arcuate, restraining boundary or surface 112 which bears against the upper surface of a corresponding one of conveyor lower side flanges 76 to prevent the front end portion of conveyor 22 from lifting upwardly.

Restraining surface 112 and pivot block 104 cooperate to permit relative angular movement between conveyor 22 and shield 20 while also carrying the vertical reaction loads generated by excavator tool 32. As shield 20 pivots relative to the front end portion of conveyor 22 about a horizontal axis extending through pivot segments 104, conveyor lower side flanges 76 bear downwardly on said pivot segments 104 causing them to rock within their particular block members 103. Correspondingly, the arcuate restraining surface 112 insures that the height separating cap 108 and a corresponding pivot segment 104 remains substantially constant as the conveyor changes in slope thus preventing conveyor lower side flange 76 from binding between cap 108 and pivot segment 104.

Figure 4:
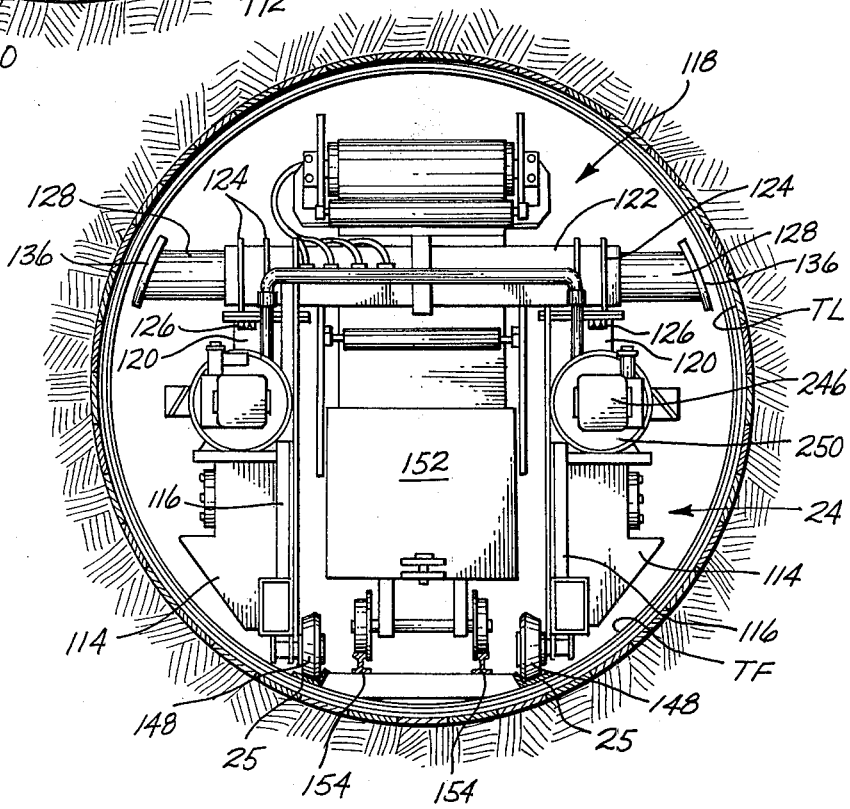
FIG. 4 is a rear elevational view of the typical embodiment shown in FIG. 1.

As best shown in FIGS. 1A and 1B, from its connection with sockets 100, conveyor 22 rises upwardly as it extends rearwardly through the tunnel. The rear end portion of conveyor 22 is supported by mobile power unit 24 which trails said conveyor 22 as it is pulled forwardly through the tunnel by shield 20. Power unit 24, as illustrated in FIGS. 1B and 4, is constructed from two elongate banks of generally rectangularly shaped hydraulic tanks 114, with each bank mounted on horizontally elongate, upright side plates 116 which are spaced apart in parallel relationship by a central cross frame structure 118. Cross frame structure 118 includes an upright post 120 which extends upwardly from a location centrally along the length of side plates 116 to an elevation substantially above hydraulic tanks 114. The upper ends of upright posts 120 are joined together by a transverse, horizontally disposed circular cross tube 122. Downwardly Open, U-shaped clamps 124 partially encircle each end portion of cross tube 122 and extend, through vertical holes provided in a horizontal end plate fixedly attached to the upper end of each upright post 120 to engage with nuts 126 to thereby tightly clamp cross tube 122 to said upright post 120. A tubular arm 128, having an outside diameter slightly smaller than the inside diameter of circular cross tube 122, extends laterally outwardly from each end portion of said cross tube 122 to a location adjacent the inside diameter of tunnel lining 51. A reaction pad 136 is fixedly attached to the outer end portion of each tubular arm 128 to bear against said tunnel lining 51 whenever power unit 24 and the rear end portion of conveyor 22 are lifted upwardly during use of excavator tool 32.

Referring specifically to FIG. 1B, the connection between power unit 24 and the rear end portion of conveyor 22 is accomplished through means of vertical eye plate 138 extending forwardly from and fixedly attached to the outer circumference of circular cross tube 122 at a location generally centrally between the ends of said cross tube 122. A pair of parallel, rearwardly directed conveyor eye plates 140 extend rearwardly from circular tubular cross member 142 which transversely interconnects triangularly shaped ear plates 144 extending downwardly from the lower edge of conveyor side plates 58. Conveyor eye plates 140 straddle power unit eye plate 138 and are pivotally connected thereto by cross pin 146 extending somewhat loosely through aligned openings provided in said eye plates 140 and 138. It can be appreciated that this particular construction permits relative pivoting movement of conveyor 22 and power unit 24 about the longitudinal axis of cross pin 146. Also, the somewhat loose fit between cross pin 146 and eye plates 138 and 140 permits a certain amount of lateral angular movement between conveyor 22 and power unit 24, thereby enabling the present invention to be used to dig tunnels which curve about a relatively small radius in comparison to the minimum radius possible for tunnels formed by conventional shielded tunneling machines.

As best shown in FIGS. 1B and 4, power unit 24 is supported by axled wheels 148 which ride on a pair of parallel rails 25 placed along tunnel floor TF. Muck cars 152 travel on a second set of more narrowly spaced rails 154 disposed between power unit rails 25. As best shown in FIG. 4, muck cars 152 are receivable between power unit side plates 116 thereby permitting said muck cars to roll forwardly to a location below the rear end portion of conveyor 22 to receive the mined muck falling downwardly from conveyor belt 62.

Carriage 28, for supporting elongate boom 30, as shown in FIGS. 1A, 3 and 5, is constructed generally in the form of an enclosed box or frame structure 155 having a forward vertical wall formed by front plate 156 fabricated in the shape of an upwardly truncated equilateral triangle. Sloped side plates 158 extend rearwardly from the diagonal side edges of front plate 156. The upper end edge portions of front plates 156 and side plate 158 are interconnected by a first top plate 160 which abuts a sloped second top plate 162 spanning across the diagonally disposed upper edge portions of side plates 158. A flat upper floor plate 164, shown most clearly in FIG. 5, spans laterally to connect with lower edge portions of side plates 158 and abuts against the lower rear surface of front plate 156. A second floor plate 166, formed generally in the shape of a downwardly open shallow trough, bears upwardly against the lower surface of upper floor plate 164 and also abuts against the lower rear surface of front plate 156. An upright rear plate 168 abuts against the rear edge portions of sloped second top plate 162 and upper and lower floor plates 164 and 166, FIG. 1A. Also, a pair of laterally spaced, parallel boom anchor plates 170 extend upwardly from top plate 160 and forwardly from front plate 156. It can be appreciated that this particular construction of carriage frame member 155 results in an extremely strong and rugged structure capable of withstanding the loads and abuses encountered during normal tunneling operations.

As best shown in FIGS. 1A, 5 and 6, carriage 28 is guided and supported for longitudinal movement along conveyor 22 by rails 26 disposed along each side of said conveyor 22. To mate with rails 26, carriage 28 includes sliding blocks 172 and 173 mounted on the forward and rear end portions, respectively, of an elongate block mounting plate 174 disposed on each side of carriage frame 155 and fixedly attached, as for instance by weldments, to carriage frame front plate 156, lower floor plate 166 and rear plate 168. Mounting plate 174 extends slightly forwardly of carriage front plate 156 and slightly rearwardly of rear plate 168. As perhaps most clearly shown in FIGS. 3, 5 and 6, each block 172 and 173 includes a laterally inwardly open, C-shaped slot or opening extending along its length for slidably receiving circular rail 26 therethrough. Each block 172 and 173 also has a flat back face which abuts against the adjacent laterally inwardly directed face of block mounting plate 174. Sliding blocks 172 and 173 are bolted to their respective mounting plates 174 by capscrews 176 which extend through holes provided in the forward and rearward end portions of mounting block plate 174 to engage with aligned threaded holes provided in said sliding blocks 172 and 173. Shims 178 of various thicknesses may be selectively inserted between sliding blocks 172 and 173 and mounting plate 174 to accommodate any lack of parallelism between the two pairs of laterally spaced sliding blocks 172 and 173 to ensure that carriage 28 freely rides on support rails 26. Also, a dust cap 180, having a C-shaped opening corresponding to the similarly shaped opening of sliding blocks 172 and 173, is mounted to the forward end of the sliding blocks 172 adjacent carriage front plate 156 and the rearward end of sliding blocks 173 adjacent carriage rear plate 168 by conventional means such as by capscrews. Dust caps 180 retain a canned wiper, not shown, between said dust caps and a corresponding sliding block 172 and 173 to wipe dust and other particles away from rails 26 before blocks 172 and 173 slide by.

Figure 2:
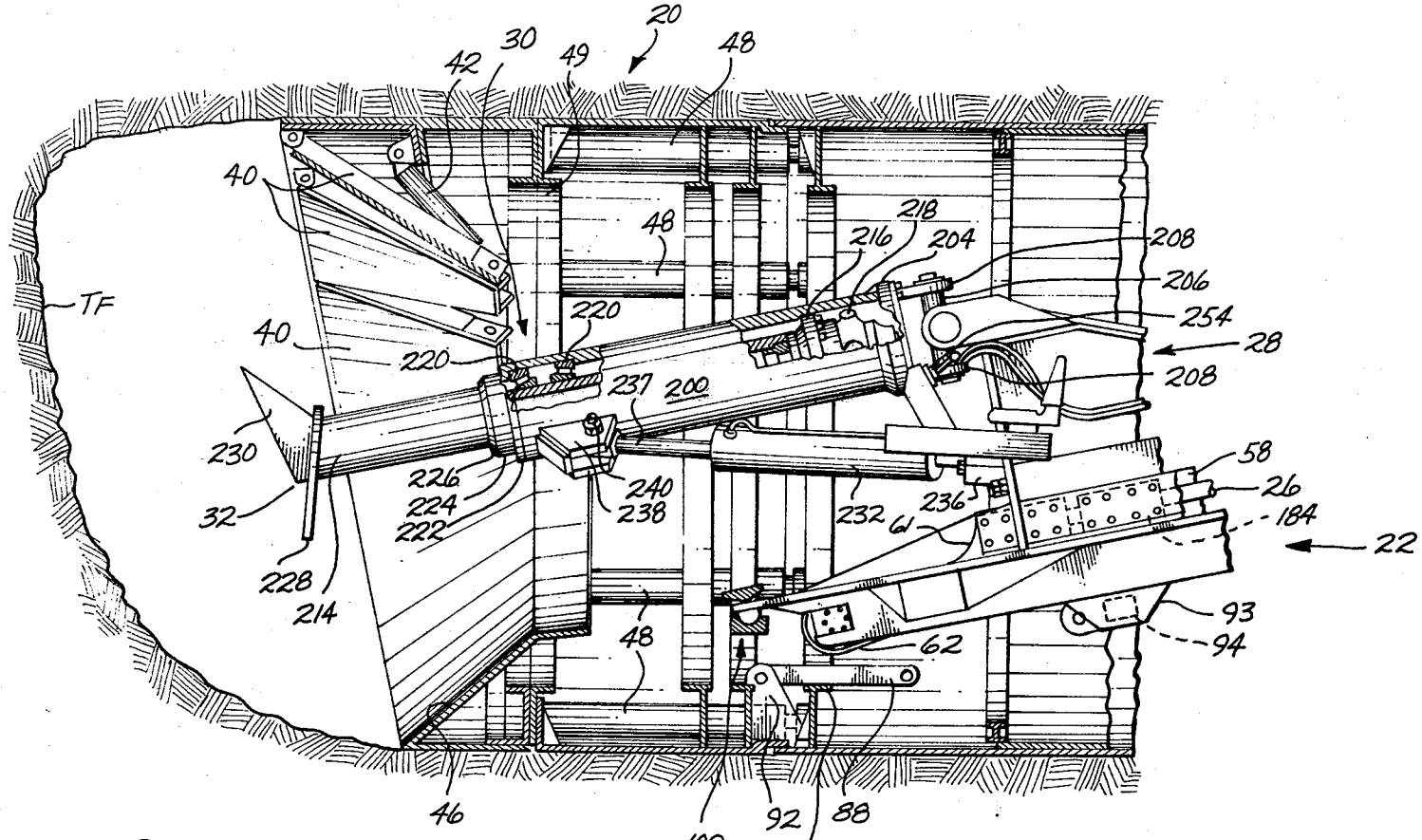
FIG. 2 is a fragmentary side elevational view of the forward portion of the tunneling machine illustrating the conveyor in its retracted position.

Referring to FIGS. 1A and 2, a spare forward sliding block 184 is disposed rearwardly of sliding block 172 on each rod 22. Correspondingly, a spare rearward sliding block 186 is disposed forwardly of each sliding block 173. These spare forward and rearward sliding blocks 184 and 186, respectively, are loosely attached to mounting plate 174 so as not to carry any appreciable load. Consequently, blocks 184 and 186 can be conveniently slid into place and rigidly bolted to mounting plate 174 to replace corresponding blocks 172 and 173, respectively, after either or both of the blocks 172 and 173 have worn out, without having to remove carriage 28 from conveyor 22.

Carriage 28 is powered for fore-and-aft movement along conveyor 22 by a pair of fluid jacks in the form of double acting hydraulic cylinders 190, FIGS. 1A and 1B. Cylinders 190 have their rear or cylinder end portions pinned by cross pins 192 to mounting ear plates 194 which extend upwardly from conveyor frame side plates 58 at a location slightly rearwardly of support rails 26, FIG. 1B. The forward or rod portion of each hydraulic cylinder 190 extends through an opening provided in the lower portion carriage front plate 156 to engage with fasteners in the form of nut 196 and lock nut 198. By connecting hydraulic cylinders 190 to carriage front plate 156, the rod portion of hydraulic cylinders 190 are protected against contamination and damage from mined materials by portions of the closely overlying carriage frame 155. This is especially important since contamination of exposed, sliding machine surfaces, such as hydraulic cylinder rods, is a common source of tunneling machine wear and failure.

Now referring to FIGS. 1A, 2 and 3, an elongate boom 30 is illustrated as mounted on carriage 28 for fore-and-aft movement along the length of conveyor 22. Boom 30 includes a rear or outer tubular member 200 capped by end plate 204 which closes off the rear end of said tubular member 200. Universal or cross member 206 is pivotally mounted on swivel plates 208 which extend rearwardly from end plate 204 in spaced parallel relationship. Each swivel plate 208, as illustrated in FIG. 5, has an opening for receiving the outer race of a spherical bearing 210 while the inner race of said bearing engages over a corresponding arm of universal 206. Spherical bearings 210 accommodate any non-parallelism between swivel plates 208 and also any misalignment between the openings in said swivel plates 208 which receive universal 206. Universal 206 also engages with parallel, spaced anchor plates 170 affixed to the upper portion of carriage frame 155. Spherical bearings 212 are pressed between the outer diameter of the arms of universal 206 and the inside diameter of aligned holes provided in anchor plates 170 to accommodate any non-parallelism between said anchor plates and misalignment of said anchor plate holes. It can be appreciated that universal 206 permits boom 30 to simultaneously pivot about the two perpendicularly disposed axes defined by the arms of universal 206, thereby enabling tool 32 to reach the entire surface of tunnel face TF.

Again referring to FIGS. 1A, 2 and 3, boom 30 also includes a front or inner tubular member 214 which extends a considerable distance rearwardly into boom outer tubular member 200. The rear end portion of boom inner member 214 is bolted to the carrier assembly of a planetary reduction gear assembly 216 which is housed within boom outer member 200, FIG. 2. Planetary reduction gear assembly 216 is in turn coupled to the output shaft of a hydraulic gear motor 218 which is also located within boom outer member 200. Reduction gear assembly 216 enables boom inner member 214 to rotate about its longitudinal axis at a speed considerably slower than the rotational speed of the output shaft of hydraulic motor 218.

Again referring to FIG. 5, the forward portion of boom inner member 214 is antifrictionally supported by a pair of spaced bearings 220 which engage over the outer diameter of said boom inner member 214 and seat within a shoulder formed in the inside diameter of boom outer member 200. The front end of boom member 200 is tightly sealed with respect to boom inner member 214 by a face seal, not shown, disposed between an annularly shaped inner seal retainer 222 which is bolted to the end of said boom outer member 200 and an outer seal retainer 224 which is bolted to a ring retainer 226.

These rings insure not only that foreign matter is prevented from entering within boom outer member 200, but also that boom 30 sufficiently strong to withstand impacts caused by falling mined material.

Next referring to FIGS. 1A, 2 and 3, an excavator tool 32 is fixedly attached to the front end of boom inner member 214. Tool 32 is constructed from a flat hoe plate 228 which is affixed transversely to the front end of boom inner member 214 to serve as a scraper or hoe to drag mined material which has fallen to the tunnel floor rearwardly up over shield apron 46 and onto conveyor belt 62. A pointed digging tooth 230 extends perpendicularly forwardly and diagonally upwardly from the front face of hoe plate 228. Tooth 230 is adapted to conveniently dig and loosen the earth and rock at the tunnel face TF.

Boom 31, as illustrated in FIGS. 1A, 2 and 3, is controlled or powered for pivotal movement relative to carriage 28 by a pair of fluid jacks in the form of hydraulic cylinders 232 which are pivotally connected between the front end portion of boom outer member 200 and the front face plate 156 of carriage 28. The rear end portion of each hydraulic cylinder 232 is pivotally attached to a ball joint 234 which in turn is bolted to mounting blocks 236 welded to the diagonal side edges of carriage front plate 156 at an elevation below carriage anchor plates 170, FIG. 5. These ball joints permit hydraulic cylinders 232 to pivot universally relative to carriage 28. The forward or rod end portion 237 of each hydraulic cylinder 232 is pinned between spaced apart, parallel mounting ears 238 which are mounted to the front end portion of boom outer member 200. A cross pin 240 extends through aligned openings provided in mounting ears 238 and an opening provided in rod end portion 237. Since hydraulic cylinders 232 are not aligned perpendicularly with respect to their corresponding cross pins 240, a spherical bearing is disposed between each rod end 237 and cross pin 240.

It can be appreciated that, by connecting hydraulic cylinders 232 to carriage 28 at a location below the elevation at which boom outer member 200 is connected to said carriage 28, this construction enables boom 30 to be pivoted relative to said carriage 28 simply by means of said two hydraulic cylinders 232. No additional hydraulic cylinders, linkage mechanisms or expensive gear motors are required to move excavating tool 32 about tunnel face TF or to hoe loosened material onto conveyor 22.

Referring to FIGS. 1A, 1B and 3, hydraulic fluid is supplied to control cylinders 232 through lines 242 and 244 from hydraulic pumps 246 and 248 powered by electric motor 250. Hydraulic fluid is also supplied to the boom hydraulic gear motor housed within boom 30 from power unit 24 through line 252. However, before hydraulic fluid reaches boom 30, it flows through operator controlled valves 254 which are located in front of operator seat 256, mounted on the left side of carriage 28 when facing tunnel face TF.

To utilize the present invention to dig a tunnel, a vertical shaft is first dug into the ground to the desired depth of the beginning of the tunnel. Next, powered shield 20 is lowered into the vertical shaft and aligned with the direction of the tunnel. Using the back side of the vertical hole as a backstop, the shield forward and intermediate sections 34 and 36 are powered forwardly by thrust rams 48, while the tunnel face is dug either manually or with the aid of portable digging apparatus. Once shield 20 is buried axially in the direction the tunnel is to run, power unit 24 is lowered into the vertical shaft behind said shield. Next, conveyor 22 with its associated carriage 20 and boom 30 is simply lowered into place, lead end first down the shaft. The front end portion of conveyor 22 is then connected to shield 20 through sockets 100 and link 88, and the rear end portion of said conveyor 22 connected to power unit 24 by cross pin 146. Lastly, the various hydraulic hoses running between power unit 24 and boom 30 and conveyor 22 are simply hooked up.

It can be appreciated that, with this arrangement and unlike the situation in conventional shielded tunneling machines, very little assembly of the present invention need take place within the tunnel after shield 20 has been buried. Consequently, not only can actual digging begin much sooner and with much less expense than with conventional machines, but the likelihood that the machine will be misassembled is virtually eliminated, since almost all the assembly occurs at the factory rather than in the hole.

To operate a machine according to the present invention to actually dig a tunnel, with carriage 28 in position at the front end portion of conveyor 22, boom 30 is pivoted about said carriage 28 so that digging tooth 230 can dig and loosen the material at tunnel face TF which then falls to the tunnel floor. Simultaneously, shield thrust rams 48 are extended to force shield forward section 34 and intermediate section 36 forwardly into tunnel face TF. After a sufficient volume of material has collected at the bottom of tunnel face TF, excavator tool hoe plate 228 can be used to pull or hoe such loosened material up apron 46 and onto conveyor belt 62. This is accomplished by lowering boom 30 and then retracting carriage 28 rearwardly along conveyor 22. Thereafter, boom 30 is then lifted and carriage 28 extended forwardly so that tool 32 can again drag more mined material onto conveyor 22. On belt 62, the mined material or muck is carried rearwardly and upwardly through the tunnel by conveyor 22 and then is dropped into an awaiting muck car 152 located below the rear end portion of said conveyor 22. If the tunnel is composed of loose material which will not support itself, tunnel face TF can be prevented from caving in by extending breasting doors 40 forwardly closing off the upper portion of shield forward section 34 to thus form a support surface for tunnel face TF.

Once thrust rams 48 have reached the end of their travel, they are retracted, thereby drawing shield tail section 38 forwardly so that additional girth ribs 52 and lagging 54 can be assembled within said shield tail section 38.

If the front end portion of conveyor 22 becomes clogged with muck, as illustrated in FIG. 2, the entire conveyor 22, carriage 28 and boom 30 can be retracted rearwardly relative to shield 20 by simply removing cross pin 96 at the rearward end of link 88 and then pushing excavator tool 32 against tunnel face TF by extending carriage hydraulic cylinders 190, thereby sliding conveyor frame 56 rearwardly over socket pivot segments 104. Once conveyor 22 is retracted, the area behind apron 46 is readily accessible to workmen for convenient removal of any muck there located. Thereafter, conveyor 22 can be slid forwardly by either anchoring excavator tool 32 in tunnel face TF or catching excavator hoe plate 228 over the leading edge of shield forward section 34 and then retracting double acting carriage cylinders 190. Lastly, link 88 is simply reconnected with eye plate 90.

Moreover, conveyor 22 can be retracted a considerable distance rearwardly of shield 20, for instance, to prevent damage to the front end of conveyor 22 during blasting at tunnel face TF or to gain additional room within shield 20 when making repairs thereto. As in the procedure described directly above, cross pin 96 is first removed from link 88. Then conveyor 22 can be moved rearwardly initially by using excavator tool 32 to push against tunnel face TF and thereafter a power traction unit, not shown, or other device can be hooked to power unit 28 to pull said power unit, together with conveyor 22, rearwardly. Alternatively, the total retraction of conveyor 22 can be accomplished by using only the traction unit. A dolly, not shown, adapted to ride on rails 154, or a similar supporting structure, may be placed under the front end of conveyor 22 to support it after conveyor frame 56 has slid rearwardly off of socket pivot segments 104. Conveyor 22 can be conveniently reconnected with shield 20 by simply reversing the above procedure.

The invention may be embodied in other specific forms without departing from the spirit or central characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

What is claimed is:

1. In a tunneling machine having a self-propelled shield, an elongate boom having a digging tool carrying front end portion, a carriage pivotally supporting the boom, control means carried by the boom support carriage for pivoting the boom up and down and sideways to move the boom about the tunnel face, and the improvement comprising:

a elongate, conveyor;

support and guideway means disposed along said conveyor for guiding the boom support carriage for longitudinal travel along said conveyor while preventing transverse movement of the carriage relative to said conveyor;

means for advancing and retracting the carriage along said support and guideway means to move the boom longitudinally relative to said conveyor; and connection means for detachably connecting a forward portion of said conveyor to the tunneling shield, said connection means including:

first connection means for connecting a forward end portion of said conveyor to the tunneling shield for towing said conveyor with the tunneling shield while simultaneously permitting said conveyor to pivot about a horizontal axis and to a limited degree about a vertical axis relative to the tunneling shield; and second connection means fixedly attached to the tunneling shield and engageable with the forward end portion of said conveyor to vertically support the forward end portion of said conveyor and permit the conveyor to slide longitudinally, rock about a horizontal axis and pivot a limited degree about a vertical axis relative to the tunneling shield, while preventing any appreciable vertical or lateral movement of the conveyor forward end portion relative to the tunneling shield.

2. The improvement according to claim 1, wherein said support and guideway means includes a pair of elongate, parallel, circular support rails secured to and extending along upper side portions of said conveyor; and at least one sliding block having a slot extending therethrough for closely, partially encircling each support rail to slide along said support rail without being transversely detachable therefrom, said sliding block securely, detachably connected to the carriage.

3. The improvement according to claim 1, wherein said first connection means includes an elongate link; and means for pivotally detachably attaching one end portion of said link to said tunneling shield and for pivotally, detachably attaching the opposite end portion of said link to an underside portion of said conveyor.

4. The improvement according to claim 1, wherein:

said conveyor includes an elongate frame constructed from an elongate beam structure and flanges extending laterally from the forward end portion of said beam structure; and said second connection means includes a socket on each side of the conveyor for receiving a corresponding frame beam structure flange, each of said two sockets having an upper boundary for bearing downwardly against a corresponding flange to prevent the front end portion of the conveyor from rising upwardly during use of the tunneling machine.

5. The improvement according to claim 1, further comprising:

a mobile power unit for powering said conveyor, said advance-retract means, the control means, and the boom all independently of the tunneling shield; and rear connection means for pivotally interconnecting the rear end portion of said conveyor with said mobile power unit to vertically support the rear end portion of said conveyor and tow said power unit behind said conveyor, said rear connecting means permitting the rear end portion of said conveyor to pivot relative to the tunneling shield about a horizontal axis and, to a limited degree, about a vertical axis.

6. In a tunneling machine having a shield, the improvement comprising:

a conveyor for moving mined material rearwardly through the tunnel, said conveyor comprising an elongate frame having a forward portion detachably connectible to the tunneling shield;

support and guideway means disposed along said conveyor frame;

a boom support carriage including means for mounting said carriage on said support and guideway means for fore-and-aft travel therealong;

elongate boom means having a digging tool carrying front end portion and a rear end portion pivotally connected to said boom support carriage;

means for advancing and retracting said carriage along said support and guideway means to move said boom means longitudinally of the tunnel;

control means carried by said carriage for pivoting said boom means up and down and sideways to move the boom front end portion about the tunnel face;

connection means mounted within the tunneling shield for detachably connecting the forward portion of said conveyor frame so that said conveyor frame can be disconnected from the tunneling shield and moved rearwardly through the tunnel;

wherein said conveyor frame includes an elongate beam structure having flanges extending laterally from the forward end portion of said beam structure; and wherein said connection means includes a socket on each side of said conveyor for receiving a corresponding frame beam structure flange, each of said two sockets having an upper boundary for bearing downwardly against a corresponding flange to prevent the front end portion of said conveyor from rising upwardly during use of the tunneling machine.

7. The improvement according to claim 6, wherein each frame structure flange includes an upwardly directed surface which makes rocking contact with the connecting means upper boundary.

8. The improvement according to claim 6, wherein each of said two sockets includes a pivoting lower boundary bearing upwardly against the lower surface of a corresponding frame beam structure flange to support the front end portion of the conveyor, said lower boundary permitting said flange to slide thereover.

9. A tunneling machine comprising:

a powered tunneling shield;

a conveyor for moving mined material rearwardly to a pickup station, said conveyor comprising a frame in the nature of an elongate beam having a forward portion connected to the tunneling shield;

support and guideway means secured to and extending along side portions of said conveyor frame;

a boom support carriage comprising a base and means for mounting said carriage on said support and guideway means for longitudinal travel therealong;

elongate boom means having a digging tool carrying front end portion and a rear end portion;

a connection means pivotally connecting the rear end portion of said boom means to said boom support carriage;

means for advancing and retracting said carriage along said support and guideway means to move said boom means longitudinally of the tunnel;

control means for pivoting said boom means up and down and sideways about said connection means to establish position of the boom front end portion at the tunnel face;

wherein said conveyor frame includes an elongated beam structure having flanges extending laterally from said beam structure; and wherein said connection means includes a socket on each side of said conveyor for receiving a corresponding frame beam structure flange, each of said two sockets making rocking contact with an upper surface of a corresponding frame beam structure flange to prevent the front end portion of said conveyor from rising upwardly during use of the tunneling machine.

10. A tunneling machine according to claim 9, wherein each of said two sockets makes rocking contact with a lower surface of a corresponding frame beam structure flange to upwardly support the front end portion of the conveyor, said sockets permitting said beam structure flanges to slide relative thereto.

* * * * *